US005088259A

United States Patent [19]

Myers

[11] Patent Number: 5,088,259

[45] Date of Patent: Feb. 18, 1992

[54] ROOF CONSTRUCTION SYSTEM

[76] Inventor: J. Milton Myers, 16561 Greenfield Rd., Southfield, Mich. 48235

[21] Appl. No.: 409,266

[22] Filed: Sep. 18, 1989

Related U.S. Application Data

[60] Division of Ser. No. 120,935, Nov. 16, 1987, abandoned, which is a continuation-in-part of Ser. No. 22,104, Feb. 27, 1987, abandoned.

[51] Int. Cl.[5] ..... E04B 5/00

[52] U.S. Cl. ..... 52/410; 52/408; 52/309.8; 52/799

[58] Field of Search ..... 52/408-410, 52/411, 741, 309.8, 799

[56] References Cited

U.S. PATENT DOCUMENTS

| | | | |
|---|---|---|---|
| 1,574,586 | 2/1926 | Loucks et al. | 52/537 |
| 2,861,525 | 11/1958 | Curtis et al. | 52/408 X |
| 3,694,306 | 9/1972 | Fricklas | 52/408 X |
| 4,122,203 | 10/1978 | Stahl | 427/222 X |
| 4,347,285 | 8/1982 | Batdorf | 427/397.8 X |
| 4,449,336 | 5/1984 | Kelly | 52/408 X |
| 4,492,064 | 1/1985 | Bynoe | 52/408 X |
| 4,542,040 | 9/1985 | Nowak | 427/426 X |
| 4,558,550 | 12/1985 | Marchais et al. | 52/408 X |
| 4,560,618 | 12/1985 | Goswami | 52/408 X |
| 4,669,246 | 6/1987 | Freeman | 52/309.8 X |
| 4,707,961 | 11/1987 | Nuuley et al. | 52/741 X |
| 4,723,385 | 2/1988 | Küllström | 52/404 X |

FOREIGN PATENT DOCUMENTS 2706255 8/1978 Fed. Rep. of Germany ..... 52/408

OTHER PUBLICATIONS

Monroe Maintenance Guide, Sales Brochure, The Monroe Company Inc., ©1975.

*Primary Examiner*—Richard E. Chilcot, Jr.

*Attorney, Agent, or Firm*—Gifford, Groh, Sprinkle, Patmore and Anderson

[57] ABSTRACT

A building roof structure includes a roof deck having a first fire-retardenat layer affixed to and extending at least partway across at least one of the top and bottom surfaces of the deck. One or both of the thermal insulating member and a second fire-retardant layer are disposed upward of the roof deck and its affixed first fire-retardant layer. A layer of waterproof material is disposed atop the thermal insulating member or the second fire-retardant layer. Preferably, the roof deck and first fire-retardant layer are separated from the remaining layers by a moisture impermeable membrane. The preferred first-retardant layers include perlite, Kaltherm or other siliceous material disposed in a resin binder, or gypsum boards. The thermal insulating member is preferably a foamed urethane, while the waterproof layer is an elastomer. A method for constructing the disclosed roof structure is also disclosed.

14 Claims, 3 Drawing Sheets

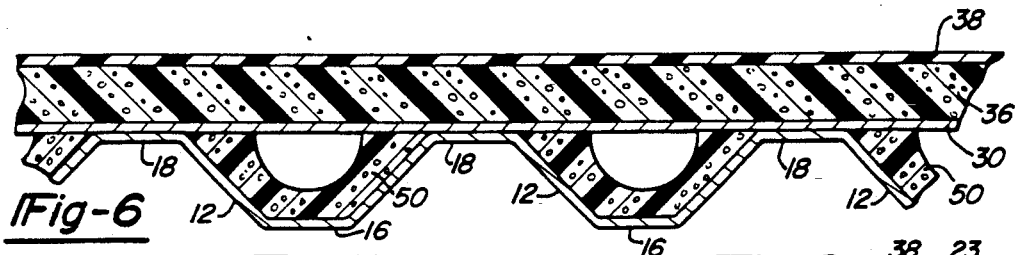
Fig-6
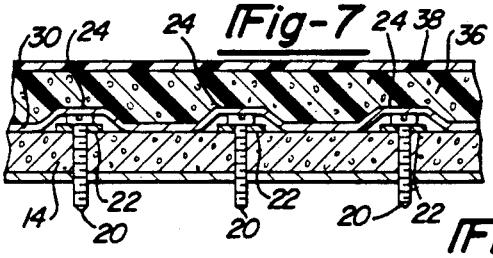
Fig-7
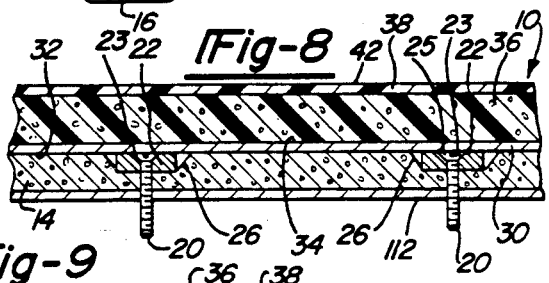
Fig-8
Fig-9
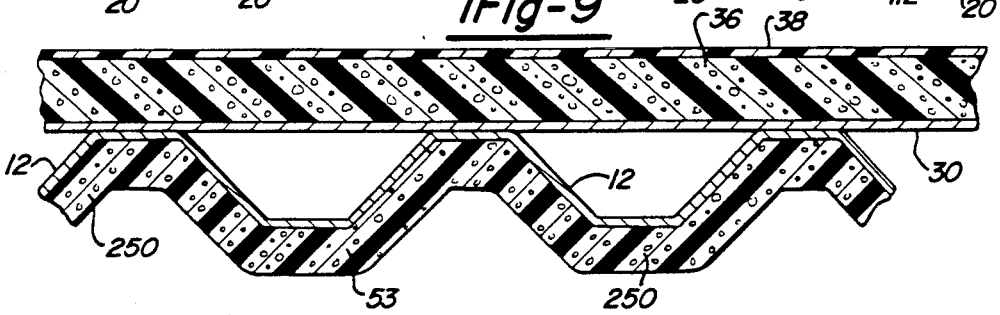
Fig-10
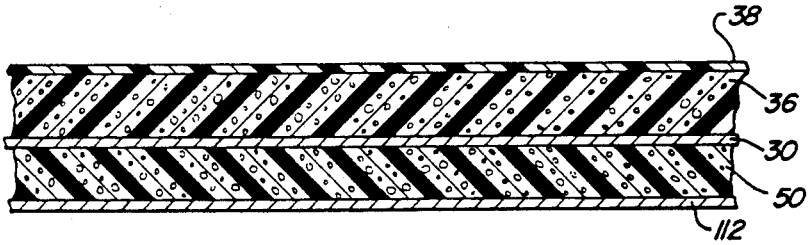
Fig-11
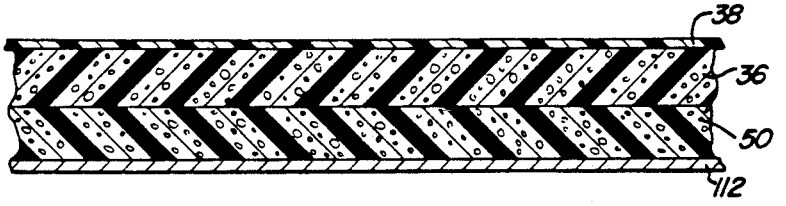
Fig-12
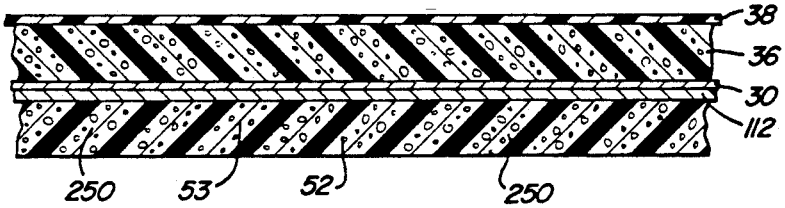

ROOF CONSTRUCTION SYSTEM

CROSS REFERENCE

This is a divisional of copending application Ser. No. 07/120,935 filed on Nov. 16, 1987 now abandoned, which is a continuation-in-part of 022,104 filed 2-27-87 abandoned.

BACKGROUND OF THE INVENTION

I. Field of the Invention

The present invention relates to building construction, and more particularly to a structure and a method of construction for a roof system useful on both new and old buildings.

II. Description of the Prior Art

One major goal of designing roof systems is to provide the optimum combination of insulating, weatherproofing and fireproofing characteristics, achieved by the most lightweight construction possible. Such a task is often made difficult because of the characteristics of the particular materials employed. For example, materials that are fireproof may not be weatherproof or have any value as insulating materials. Thus, more than one material may be required to perform these various functions. A plurality of disparate materials will add weight to the entire roof system, sometimes necessitating strengthening of the load bearing walls and the addition of further structure to support the roof.

Present designs which focus primarily on the weatherproofing function typically consist of multiple layers of asphaltic felt, joined to each other and to the roof deck by bituminous material. Such designs are subject to the drawback that they provide minimal insulation or fireproofing. It is true that insulating properties can be provided in such a system by the addition of materials such as foam, plywood sheets or other insulation material. However, such added material must normally be protected from the elements (such as sunshine, moisture and changes in temperature) by a layer of asphaltic mastic and gravel.

These design elements are commonly referred to as the IRMA system, and are substantially disclosed in U.S. Pat. No. 3,411,256. This system first comprises a membrane disposed adjacent to the roof deck, formed from a plurality of alternating layers of felt and bituminous material. A thermal insulating layer is then placed over the multiple layers of felt. This thermal insulating layer is generally both water-resistant and, to some degree, water impermeable. A top exterior surface is then applied which consists of a protective layer of mastic and granules.

Another weatherproofing design is disclosed in U.S. Pat. No. 4,016,323. In such a system, a waterproof membrane is applied directly to the surface of a roof deck, and covered with a thermal insulating foam, which is in turn covered by a weather protective elastomer. The waterproof membrane comprises a fiberglass mesh covered by a rubberized material. The membrane has a nontacky bituminous compound on its upper surface. While this design functions adequately for its intended purpose, the fact that the fiberglass portion is not flammable does not mean that the disclosed roof construction is fire-resistant, nor does it suggest that the structure optimally provides a combination of insulating, weatherproof and fireproof characteristics in an adequately lightweight construction.

SUMMARY OF THE PRESENT INVENTION

The present invention a building roof structure and a method for constructing the same which optimizes insulating, weatherproofing and fireproofing characteristics in a lightweight construction. The building roof structure of the present invention first comprises a roof deck having a top surface and a bottom surface, and first fire-retardant layer affixed to and extending at least partway across at least one of the top and bottom deck surfaces. The roof deck and first layer together define a deck member. An intermediate roofing layer is then disposed upwards of the deck member so formed. The intermediate layer is composed of at least one of a thermal insulating member and a second fire-retardant layer. The intermediate layer can be directly affixed to the deck member, or to a membrane disposed between it and the deck member. Finally, a layer of waterproof material is disposed atop the intermediate layer, opposite the deck member. Preferably, the first fire-retardant layer comprises gypsum, or perlite or a siliceous material (such as Kaltherm) in a synthetic resin binder. The thermal insulating member preferably comprises a foamed urethane material, while the waterproof layer is elastomeric.

The invention is also directed to a method of constructing such a building roof structure which comprises the steps of erecting the described deck member, applying the intermediate layer upwards of it, and disposing the layer of waterproof material atop the intermediate layer, opposite the deck member.

The roof structure of the present invention maximizes the investment of the building owner by providing superior protection from fire, superior protection from the environmental elements, and minimizing heat loss, while simultaneously permitting the construction of a building with less structural steel, thinner supporting walls and a smaller footing than would be required for a roof design utilizing the IRMA roof system or other comparable systems.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which:

FIGS. 5 through 14 are sectional views of other preferred embodiments of the present invention.

DETAILED DESCRIPTION OF THE PREFERRED EMBODIMENTS OF THE PRESENT INVENTION

Figure 1:
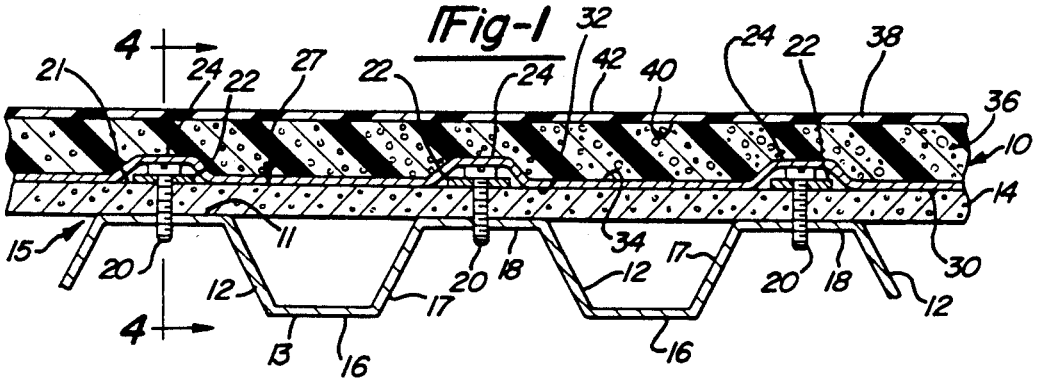
FIG. 1 is a cross-sectional view of a first preferred embodiment of the present invention.
Figure 4:
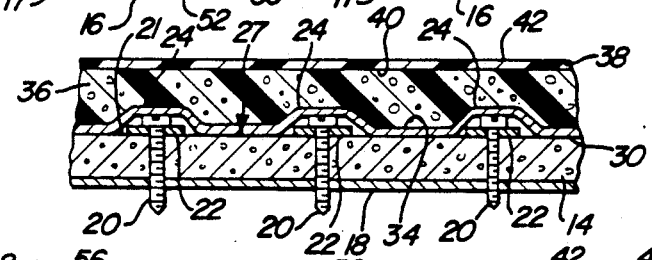
FIG. 4 is a cross-sectional view taken along line 4—4 of FIG. 1.

With references first to FIGS. 1 and 4, a building roof structure 10 according to the present invention is thereshown first comprising a metal corrugated deck 12 erected in a conventional fashion, for example, affixed atop a building by conventional means (not shown). The corrugations of the roof deck 12 are formed as a plurality of parallel, longitudinal troughs 16, separated from one another by a plurality of longitudinal, parallel ridges 18. A plurality of inclining wall segments 17 interconnect adjacently disposed ridges 18 and troughs 16. The roof deck 12 possesses an upper surface 11 and a lower surface 13.

A first fire-retardant layer such as a plurality of gypsum boards 14 is affixed to and extends at least partway across the upper surface 11 of the roof deck 12, for example, in engagement with the top surfaces of the ridges 18. The gypsum boards 14 are preferably about ½ to ⅝ inches (12 to 16 millimeters) thick. Gypsum, of course, provides excellent fire-resistant properties and functions to inhibit the spread of fire through the roof system to other parts of the building, should a fire occur. The indicated thickness of the gypsum boards 14 strikes an optimum balance between fire-retardance and the concern for overall weight factors in typical roof constructions. However, it should be readily apparent that if weight is of lesser concern, or if the support structure of the roof allows such, the thickness of the gypsum board can be increased so as to provide greater fire-retardant properties.

The gypsum boards 14 are secured to the deck 12 by means such as a plurality of self-tapping screws 20. The screws 20 can either be forcibly driven through the gypsum boards 14, or can be inserted through holes drilled in the gypsum boards 14, aligned with corresponding holes drilled or formed in the ridges 18 of the deck 12. Preferably, a washer 22 is disposed between a screwhead 24 of each of the screws 20 and an upper surface 21 of each of the gypsum boards 14. This serves to evenly disperse the compressive force of the screws 20, thereby preventing crushing or distortion of the gypsum boards 14. In this first embodiment of the first invention, the heads 24 of the screws 20 remain above the plane of the top surface 21 of the gypsum boards 14, even when in their substantially fully tightened position.

The first fire-retardant layer, as exemplified by the layer of gypsum boards 14, is secured to the upper surface 11 of the deck 12 so as to form the deck member 15 having a substantially continuous and planar top surface 27. Preferably, prior to application of the other layers and materials of the deck construction 10 of the present invention, a thin substantially water impervious membrane 30 is applied to the top surface 27 of the deck member 15. The thickness of the membrane 30 is exaggerated in FIGS. 1 and 4; preferably, the membrane is substantially thin, for example, about 0.060 inches (1.5 millimeters) thick. The membrane 30 also preferably includes a mesh core constructed of a fireproof or fire-resistant material such as fiberglass (not shown). A lower surface 32 of the membrane 30 is coated with a material such as, for example, a rubberized adhesive, which permits the membrane 30 to adhere in a substantial and permanent manner to the top surface 27 of the deck member 15. An upper surface 34 of the membrane 30 is coated with the same or a similar material.

To facilitate the method of constructing the roof system 10, the membrane 30 is preferably delivered to the roof construction sight in prepackaged form, such as in rolls of the membrane 30 with both the upper and lower coatings of rubberized adhesive previously having been applied thereon. A sheet of release material such as polyethylene film (not shown) covers the adhesive material and prevents the membrane 30 from adhering to itself while in roll form. The release sheet is removed from the membrane 30 immediately prior to application of the membrane 30 atop the deck member 15. Alternatively, it may be desirable and is contemplated within the present invention that the rubberized adhesive material layers and the mesh can be separately applied, thereby eliminating the need for any release sheet. In any event, it is preferred that the membrane 30 is self-sealing once applied to the gypsum board 14, so as to provide an excellent vapor barrier and waterproof shield to protect the gypsum boards 14, the roof deck 12 and the interior portions of the building on which the construction 10 is erected.

The construction 10 also comprises an intermediate roofing layer disposed upwards of the deck member 15 above the membrane 30, composed of at least one of a thermal insulating member and a second fire-retardant layer. As shown in FIGS. 1 and 4, in the first preferred embodiment of the present invention the intermediate roofing layer comprises a liquid urethane foam insulation material 36 applied atop the membrane 30, as the thermal insulating member. The urethane foam insulation 36 is of a thickness determined by the insulation requirements demanded by a particular building design. Preferably, the thickness of the urethane foam insulation is between 1½ and 2 inches (38 to 50 millimeters). Two inches of urethane foam insulation 36 is typically a sufficient layer for insulation purposes in general building construction.

The urethane foam insulation 36 possesses limited weather resistant characteristics. To protect the foam insulation 36 from the weather, a layer of waterproof material 38 is disposed atop the intermediate layer (here exemplified by the urethane foam insulation 36). The waterproof material 38 is preferably an elastomer which is spray applied, roller applied or brush applied across the entire upper surface of the foam insulation 36. Preferably, in order to prevent the formation of pinholes in the elastomer material 38, the elastomer is applied as a first portion undercoat 40 followed by a second portion topcoat 42. The thickness of the topcoat 42 is preferably between about 0.025 and 0.030 inches (0.6 to 0.75 millimeters). The elastomeric material 38 is selected to possess such chemical characteristics as to allow it to be integrally and permanently affixed to the top surface of the urethane foam material 36, and does not flow under heat, shrink over a period of time, or become brittle or cracked due to exposure to solar radiation.

Figure 2:
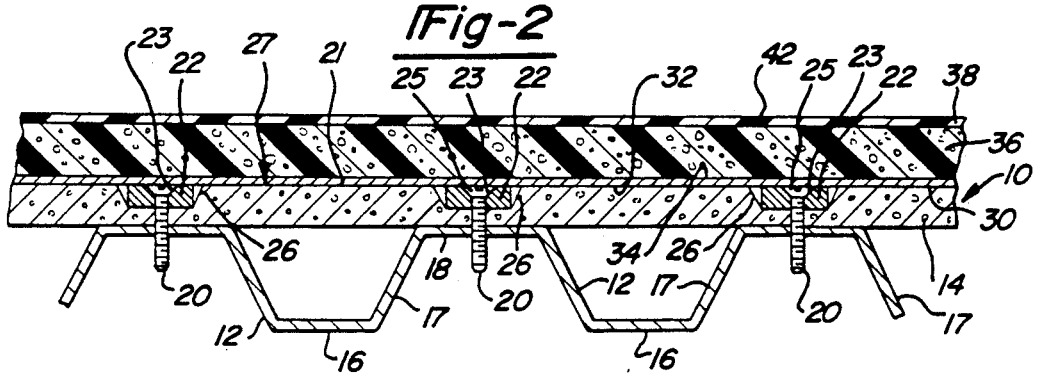
FIG. 2 is a similar view of another preferred embodiment of the present invention.

With reference now to FIG. 2, another embodiment of the present invention is thereshown in which a substantially planar top surface 27 of the deck member 15 is provided. The same gypsum boards 14 are employed as in FIGS. 1 and 4, but a plurality of substantially circular recesses 26 are formed in the top surfaces 21 of the gypsum boards 14. The diameter of each of the recesses 26 is slightly greater than the diameter of the washers 22, and the depth of each recess 26 is slightly greater than or substantially equal to the thickness of the washers 22, such that each washer 22 easily fits into its associated recess 26. A chamfer or counterbore 23 is formed on the top surface of the washer 22, at the edge of its centrally located hole, so that when the screw 20 is inserted into the hole, a tapered head 25 of the screw 20 engages the counterbore 23. In this manner, the top surface of the tapered screw head 25, the washer 22 and the gypsum boards 14 are substantially coplanar when assembled together. As in the first preferred embodiment, the screw 20 is preferably self-tapping and is either inserted through a hole in, or forcibly driven through, the gypsum boards 14, and threadingly engaged in one of plurality of corresponding holes drilled or formed in the ridge 18 of the roof deck 12.

Figure 3:
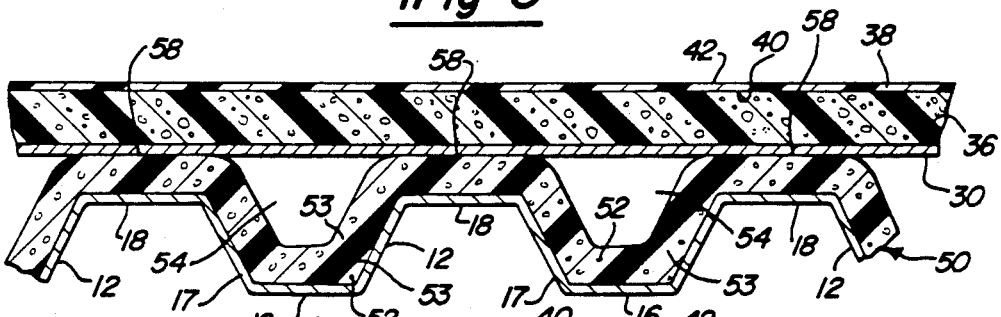
FIG. 3 is a similar view of another preferred embodiment of the present invention.

Another preferred embodiment of the present invention is shown in FIG. 3, wherein the first fire-retardant layer affixed to and extending at least partway across at least one of the upper and lower surfaces 11 and 13 of the roof deck 12 comprises, not the gypsum boards 14, but instead a fire-proof Kaltherm- or perlite-based layer 50. More particularly, the first fire-retardant layer 50 comprises a mixture of particles of Kaltherm or perlite (also known as pearlstone) 52 dispersed in a synthetic resin binder 53. Kaltherm is a trademark for a material in the form of small pellets or spheres and is well known for its fire-retardant properties. Kaltherm is the preferred material for the layer 50, although other siliceous materials are useful as well. For the sake of simplicity in the specification, however, reference to the pearlstone 52 is intended to include perlite, Kaltherm or other siliceous material.

The resin binder 53 enables the pearlstone 52 to be applied to the roof deck 12 in the form of the layer 50 such that it adheres in a very substantial and permanent manner to the upper surface 11 of the deck 12. This property is particularly useful when the roof deck 12 is corrugated; the plurality of alternating longitudinal troughs 16 and ridges 18 preclude the introduction of other, substantially rigid fire-resistant materials to fill the troughs 16. It may, of course, have been an intended object of the roof designer to fill the troughs 16 with a fire retardant material. The mixture of pearlstone 52 and the binder 53 is a high viscosity, malleable semi-liquid, capable of conforming to almost any surface topography. It can therefore be applied by use of a trowel, or other suitable tool, to the top surface 11 of the deck 12. The layer 50 formed of this mixture is preferably about ½ inch (13 millimeters) thick, such that the entire top surface of the troughs 16 and the ridges 18 are covered by the layer 50.

Figure 5:
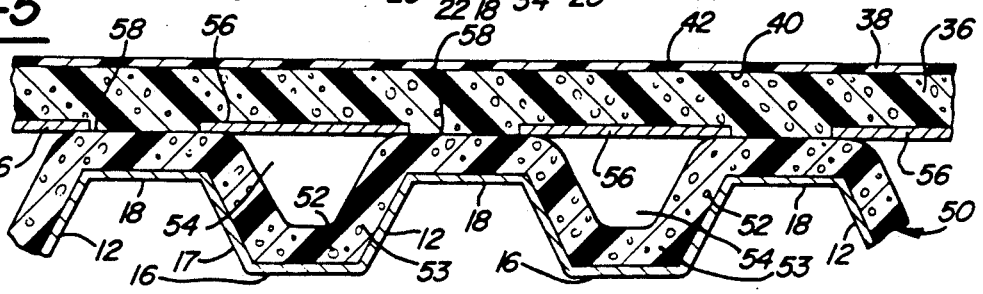

When so formed, a portion of the layer 50 will form a top surface 58 above the ridges 18 of the roof deck 12. The layer 50 and the roof deck 12 thus form a deck member similar to the deck member 15 described above. The top surface 58 of the layer 50 is thus the functional equivalent of the top surface 27 of the deck member 15. Like the first and second preferred embodiments described above, a water-resistant and vapor-proof barrier is applied atop the top surface of the layer 50, and comprises either the membrane 30 (again, consisting of a fiberglass mesh coated on each side with a rubberized piece of material); or a tape 56, shown in grossly exaggerated thickness in FIG. 5, and composed of a material such as Mylar or other suitable material. The tape 56 is applied longitudinally over the troughs 56 and affixed to adjacently disposed portions of the top surface 58, to cover the open spaces 54 between angled walls 17. The tape 56 does not need to (although it can) substantially cover the portions of the layer 50 over the ridges 18. The membrane 30, or alternatively, the tape 56, adheres in a very substantial and permanent manner to the top surface 58 of the layer 50. Thus, either the membrane 30 or tape 56 extends substantially horizontally between the top surfaces 58 of the layer 50 over the ridges 18 such that the open spaces 54 are covered by the membrane 30 or the tape 56.

Similar to the earlier described embodiments, either the membrane 30 or the tape 56 is then covered by a layer of insulating material such as the urethane form layer 36, preferably having a thickness of about 1½ to 2 inches, which is in turn covered by the elastomeric undercoat 40 and the topcoat 42, of the same thicknesses as described earlier.

With reference now to FIG. 6, another preferred embodiment of the present invention is thereshown in which the step of applying the Kaltherm or pearlstone has been facilitated by avoiding the time spent in the careful layering of the Kaltherm or pearlstone on top of the ridges 18 of the deck 12. Instead, the Kaltherm layer 50 is applied over only the troughs 16 and the sidewalls 17, partly filling the space 54 but only up to the level of the top surface of the ridges 18. The membrane 30 is then applied atop the surface of the ridges 18 so as to cover the layer 50 on the troughs 16. As in the earlier described embodiments, first the urethane foam 36 and then the elastomeric roof material 38 are applied atop the membrane 30.

Alternatively, as shown in FIGS. 7 and 8, the roof structure of the present invention can also incorporate a substantially flat wooden or metal nonfluted roof deck 112 in place of the corrugated roof deck 12 of the earlier embodiments. As in the first-mentioned preferred embodiment, a layer of the gypsum boards 14 is secured to the roof deck 112 by a plurality of screws 20 which are threadably engaged with the roof deck 112, thereby together defining the deck member 15. The washers 22 are disposed between the heads 24 of the screws 20 and the top surface 21 of the gypsum boards 14. The membrane 30 is then applied on the top of the gypsum boards 14 over the screw heads 24. Liquid urethane foam 36 is then applied on top of the membrane 30, and the elastomeric waterproof material 38 is in turn applied atop the liquid urethane foam 36. As in the embodiment shown in FIG. 2, the embodiment shown in FIG. 8 further includes the plurality of recesses 26 formed in the gypsum boards 14, the counterbores 23 (formed in the top surface of the washers 22) and the tapered screw heads 25, for the purpose of forming a substantially flat plane on the top surface 27 of the deck member 15, that is, on the top surface 21 of the gypsum boards 14, after the screws 20 are installed through the gypsum boards 14 and secured to the roof deck 112.

A still further preferred embodiment of the present invention is shown in FIG. 9, incorporating a corrugated roof deck 12, and in FIG. 12, incorporating a noncorrugated roof deck 12. In each of these embodiments the first fire-retardant layer is affixed to the lower surface 13 of the deck 12, instead of the upper surface 11 of the deck 12, as in the earlier described embodiments. The first fire-retardant comprises a layer 250 composed of the same perlite, Kaltherm or siliceous-based material as the layer 50. Like the layer 50, the layer 250 includes a resinous binder 53, which possesses adhesive properties which allow the layer 250 to cover the entire underside of the roof deck 12 or 112. In each of these embodiments, the membrane 30, the urethane foam layer 36 and the elastomeric material 38 are layered atop the roof deck 12 or 112, in the manner disclosed earlier.

A still further embodiment of the present invention is shown in FIG. 10, incorporating a nonfluted wooden or metallic roof deck 112. This embodiment is otherwise identical to that shown in FIG. 3, wherein the perlite layer 50 is laid atop the roof deck (in this case the roof deck 112) and then the membrane 30, the liquid urethane foam 36 and the waterproof elastomeric material 38 disposed thereatop.

With reference now to FIG. 11, the simplest embodiment of the present invention is thereshown. It is similar to the embodiment shown in FIG. 10 with the exception that the membrane 30 is not employed. The embodiment thus consists of the roof 112, the Kaltherm layer 50 atop the roof deck 112, the liquid foam urethane 36 disposed atop the first layer 50, and finally the waterproof elastomeric material 38 atop the liquid foam urethane 36.

Figure 13:
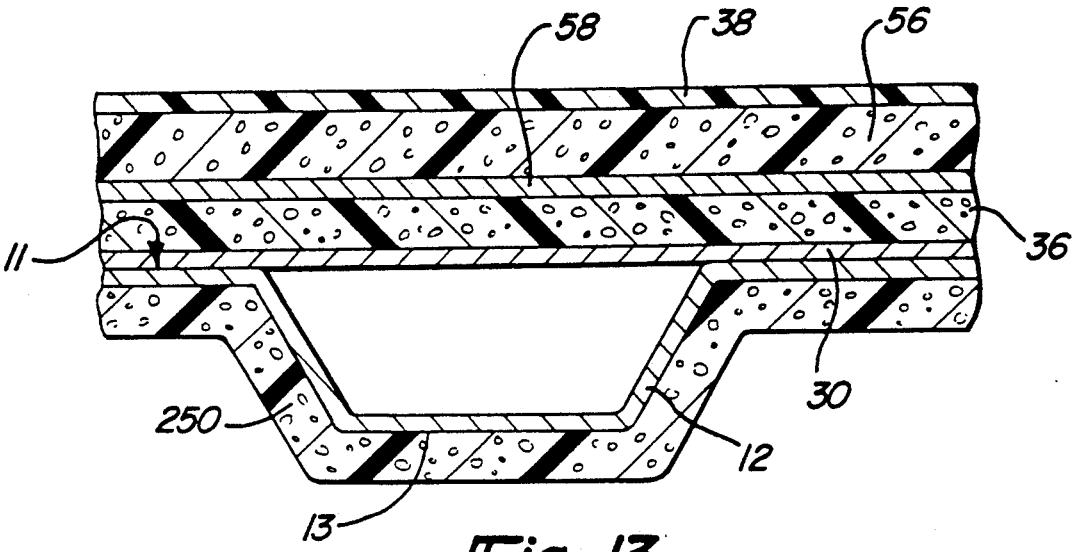
Figure 14:
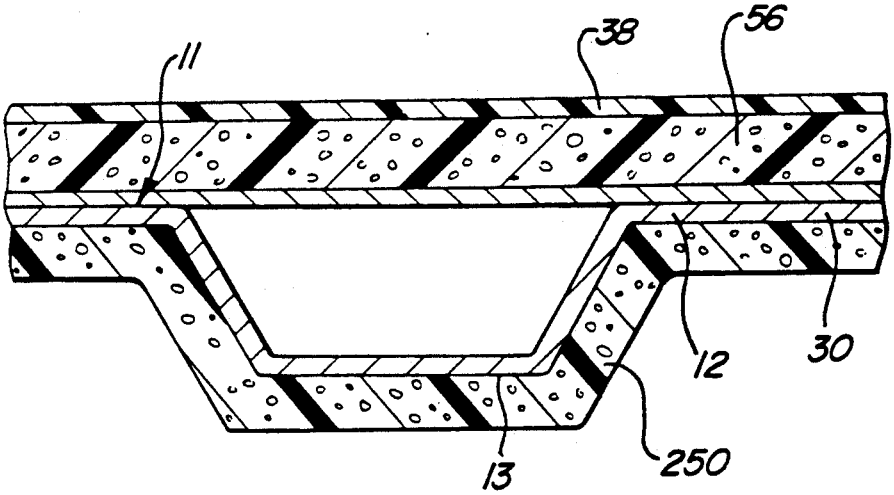

As indicated, in the present invention the layer located intermediate the deck member 15 and the waterproof elastomer 38 comprises at least one of a thermal insulating member and a second fire-retardant layer. In FIGS. 1 through 12, the intermediate layer has been disclosed as consisting of the thermal insulating member, specifically, the foamed urethane material 36. FIGS. 13 and 14 disclose two embodiments wherein the intermediate layer does not consist solely of a thermal insulating member.

More particularly, the embodiment disclosed in FIG. 13 is similar to that shown in FIG. 9, except that the intermediate layer comprises not only the urethane material 36, but additionally comprises a second heat resisting layer 56 disposed thereatop. The urethane material 36 and the second heat resistant layer 56 are separated by a second membrane 58. The membrane 58 is configured the same as the membrane 30. As in FIG. 9, the perlite or Kaltherm layer 250 is affixed to the lower side 13 of the roof deck 12.

Of course, as indicated, the intermediate layer need not include a thermal insulating member, but can be composed of only the second fire-retardant layer 56, as shown in FIG. 14. In this preferred embodiment, the first perlite layer 250 is affixed to the bottom surface 13 of the deck 12, while the membrane 30 is laid across the upper surface 11 of the deck 12. The second layer of perlite 56 is positioned atop the membrane 30, and the elastomeric material 38 applied atop the second perlite layer 56.

The methods of construction corresponding to each of the disclosed embodiments should be readily apparent from the description of those embodiments and the steps employed in affixing the various layers to one another.

It should readily be appreciated by those skilled in the art that the described roof construction system optimally achieves the advantages of a roof which is impervious to penetration by moisture (in the form of either water or vapor), which has excellent insulating and fire retardant properties. Several of the embodiments also simultaneously eliminate the need for mechanical fasteners which can contribute to wood loss and the like. These advantages, of course, are achieved simultaneously with a minimal negative impact on overall roof weight.

Having described my invention, however, many modifications thereto will become apparent to those skilled in the art to which it pertains, without deviation from the spirit of the present invention, as defined by the scope of the appended claims.

I claim:

1. A building roof structure comprising:

a metallic roof deck;

a fire retardant layer extending substantially continuously across said roof deck, comprising gypsum, perlite or a siliceous material;

means mechanically fastening said fire retardant layer to said roof deck;

a moisture impermeable vapor barrier membrane disposed atop and extending across said fire retardant layer, composed of a rubberized adhesive material different from said fire retardant layer and a reinforcing mesh core about which said adhesive material is disposed;

a thermal insulating member disposed atop and extending continuously across said membrane, comprising a urethane material foamed from a liquid applied atop said membrane; and a layer of waterproof material disposed atop and extending continuously across said thermal insulating member.

2. The invention according to claim 1, wherein said fire retardant layer is formed from a mixture of particles disposed in a synthetic resin binder.

3. The invention according to claim 2, wherein said fire retardant layer is about 12.8 mm thick.

4. The invention according to claim 1, wherein said fire retardant layer is configured as a plurality of gypsum boards.

5. The invention according to claim 1, wherein said deck is corrugated.

6. The invention according to claim 1, further comprising a second fire retardant layer affixed to and extending across said roof deck, opposite said first-mentioned fire retardant layer.

7. The invention according to claim 1, further comprising a second fire-retardant layer extending across and disposed between said membrane and said waterproof layer.

8. The invention according to claim 7, wherein said second fire retardant layer is disposed above said thermal insulating member.

9. The invention according to claim 7, wherein said second fire retardant layer is disposed below said thermal insulating member.

10. The invention according to claim 1, wherein said membrane is about 1.5 mm thick.

11. The invention according to claim 1, wherein said membrane is configured as a tape.

12. The invention according to claim 1, wherein said thermal insulating member is about 38 to 50 mm thick.

13. The invention according to claim 1, wherein said waterproof layer is elastomeric and comprises an undercoat and a topcoat.

14. The invention according to claim 13, wherein said topcoat is about 0.6 to 0.75 mm thick.

* * * * *